US008629377B2

(12) United States Patent
Forget

(10) Patent No.: US 8,629,377 B2
(45) Date of Patent: Jan. 14, 2014

(54) HEATER ASSEMBLY FOR CLOTHES DRYER

(75) Inventor: Francis Forget, Laval (CA)

(73) Assignee: Mabe Canada Inc., Burlington (CA)

( * ) Notice: Subject to any disclaimer, the term of this patent is extended or adjusted under 35 U.S.C. 154(b) by 1298 days.

(21) Appl. No.: 12/153,392

(22) Filed: May 19, 2008

(65) Prior Publication Data

US 2009/0020520 A1 Jan. 22, 2009

(30) Foreign Application Priority Data

Jul. 20, 2007 (CA) ..... 2594248

(51) Int. Cl.
*H05B 3/68* (2006.01)
*H05B 3/06* (2006.01)

(52) U.S. Cl.
USPC ..... 219/461.1; 219/467.1; 219/520; 219/536

(58) Field of Classification Search
USPC ..... 219/461, 461.1, 155, 200, 267, 467.1, 219/520, 532, 536; 174/138 G, 138 J, 167; 338/304, 305, 315, 317, 318; 285/86, 285/89, 314, 317, 358, 359, 360, 362, 394, 285/395, 401; 392/497, 347, 370, 407
See application file for complete search history.

(56) References Cited

U.S. PATENT DOCUMENTS 2,402,360 A * 6/1946 Bevins ..... 220/664
2,737,010 A * 3/1956 Piquerez ..... 368/291
2,799,458 A * 7/1957 Nye ..... 242/118.8
3,154,281 A * 10/1964 Frank ..... 248/201
3,205,590 A * 9/1965 Deaton ..... 34/527
3,344,514 A * 10/1967 Partlow et al. ..... 29/598
3,482,617 A * 12/1969 Chamberlain et al. ..... 152/214
3,504,551 A * 4/1970 Bohenek ..... 73/431
3,831,062 A * 8/1974 Haug et al. ..... 361/710
3,876,073 A * 4/1975 Herbetko ..... 242/608.7
3,880,313 A * 4/1975 Akers ..... 215/211
3,889,840 A * 6/1975 Price ..... 220/664
3,901,574 A * 8/1975 Paullus et al. ..... 439/315
3,920,887 A * 11/1975 Kloos et al. ..... 174/148
3,935,376 A 1/1976 Cooper et al.
3,963,859 A * 6/1976 Petersen et al. ..... 174/148
3,967,094 A * 6/1976 Petersen et al. ..... 219/532
4,077,586 A * 3/1978 Thomas et al. ..... 242/129.5

(Continued)

FOREIGN PATENT DOCUMENTS

| | | |
|---|---|---|
| CA | 1073510 | 3/1980 |
| CA | 2409537 | 4/2004 |
| CA | 2410001 | 4/2004 |
| DE | 3706601 | 9/1988 |

*Primary Examiner* — Henry Yuen
*Assistant Examiner* — Eric Stapleton

(57) ABSTRACT

An electric heater assembly for mounting in an electric clothes dryer supports an electrical heating element. The heater assembly has overlapping arcuate shaped support plates of mica for supporting a zig-zag shaped electrical heating element. The support plates have inner and outer concentrically curved side edge portions having inner and outer notches. A support wall mounted in the clothes dryer supports the support plates by series of inner and outer arcuate spaced apart tab members. The tab members each have a flap member. The flap members are positioned so that the notches of the support plates align with the flaps to permit the support plates to be positioned relative to the housing support wall, and then rotated, so that the flap members overlappingly engage at least one of the support plates to hold the support plates relative to the housing support wall.

25 Claims, 12 Drawing Sheets

(56) References Cited

U.S. PATENT DOCUMENTS

| | | | | | |
|---|---|---|---|---|---|
| 4,151,398 | A | | 4/1979 | Maake | |
| 4,250,399 | A | | 2/1981 | King | |
| 4,279,355 | A | * | 7/1981 | Schwartz et al. | 220/300 |
| 4,341,946 | A | | 7/1982 | Ohnmacht et al. | |
| 4,448,245 | A | * | 5/1984 | de Palezieux | 165/174 |
| 4,473,170 | A | * | 9/1984 | Ciancimino | 220/300 |
| 4,531,017 | A | | 7/1985 | Sherrill | |
| 4,628,189 | A | | 12/1986 | Danko | |
| 4,647,757 | A | * | 3/1987 | Haastrup | 392/379 |
| 4,656,340 | A | | 4/1987 | St. Louis | |
| 4,675,511 | A | | 6/1987 | Sherrill | |
| 4,713,527 | A | * | 12/1987 | Kicherer et al. | 219/461.1 |
| 4,836,580 | A | * | 6/1989 | Farrell | 285/24 |
| 4,845,345 | A | * | 7/1989 | Ohnmacht | 219/546 |
| 4,848,567 | A | | 7/1989 | Howard et al. | |
| 4,994,654 | A | * | 2/1991 | St. Louis | 219/532 |
| 5,131,693 | A | * | 7/1992 | Miller | 285/364 |
| 5,134,270 | A | * | 7/1992 | Bragg et al. | 219/532 |
| 5,235,906 | A | * | 8/1993 | Hsu | 99/483 |
| 5,298,723 | A | * | 3/1994 | Philpot | 219/532 |
| 5,334,818 | A | * | 8/1994 | Edwards et al. | 219/539 |
| 5,437,108 | A | * | 8/1995 | Alseth | 34/196 |
| 5,497,394 | A | * | 3/1996 | Jhawar et al. | 373/130 |
| 5,578,232 | A | | 11/1996 | Engelke | |
| 5,601,231 | A | * | 2/1997 | Cai | 229/110 |
| 5,641,420 | A | * | 6/1997 | Peterson et al. | 219/536 |
| 5,735,483 | A | * | 4/1998 | Bierlein | 242/608.7 |
| 5,791,590 | A | * | 8/1998 | Zuk et al. | 242/610.6 |
| 5,836,554 | A | * | 11/1998 | Lesage | 248/152 |
| 5,867,583 | A | * | 2/1999 | Hazelwood et al. | 381/395 |
| 5,880,366 | A | * | 3/1999 | Yamaguchi | 73/204.26 |
| 5,887,512 | A | * | 3/1999 | Kakimoto et al. | 99/348 |
| 5,916,466 | A | * | 6/1999 | Dixon | 219/536 |
| 5,935,471 | A | | 8/1999 | St. Louis | |
| 6,002,116 | A | * | 12/1999 | St. Louis | 219/542 |
| 6,041,696 | A | * | 3/2000 | Su | 99/483 |
| 6,085,442 | A | * | 7/2000 | Erickson | 34/381 |
| 6,088,928 | A | * | 7/2000 | Sugimoto | 34/144 |
| 6,108,940 | A | * | 8/2000 | St. Louis | 34/601 |
| 6,222,133 | B1 | * | 4/2001 | St. Louis | 174/138 J |
| 6,259,070 | B1 | * | 7/2001 | Audet | 219/461.1 |
| 6,276,832 | B1 | * | 8/2001 | Wade, III | 384/204 |
| 6,345,719 | B1 | * | 2/2002 | Jaycox | 206/570 |
| 6,509,554 | B2 | * | 1/2003 | Howard et al. | 219/536 |
| 6,575,398 | B2 | * | 6/2003 | Nakamura et al. | 242/608.7 |
| 6,596,974 | B2 | * | 7/2003 | Howard et al. | 219/536 |
| 6,770,855 | B2 | * | 8/2004 | Howard et al. | 219/536 |
| 7,017,953 | B2 | * | 3/2006 | Benscoter et al. | 285/401 |
| 7,047,663 | B2 | * | 5/2006 | Zhang et al. | 34/348 |
| 7,157,818 | B2 | * | 1/2007 | Jones | 310/63 |
| 7,566,079 | B1 | * | 7/2009 | Callahan et al. | 285/362 |
| 7,988,544 | B2 | * | 8/2011 | Vanden Bosch et al. | 454/367 |
| 2003/0116558 | A1 | * | 6/2003 | Lipp et al. | 219/493 |
| 2003/0184091 | A1 | * | 10/2003 | Ricard | 285/358 |
| 2005/0005548 | A1 | * | 1/2005 | Charron | 52/302.1 |
| 2005/0121912 | A1 | * | 6/2005 | Benscoter et al. | 285/401 |
| 2006/0191947 | A1 | * | 8/2006 | Jedryk et al. | 220/788 |
| 2006/0220352 | A1 | * | 10/2006 | Clarke et al. | 280/728.2 |
| 2006/0225389 | A1 | * | 10/2006 | Scott et al. | 55/498 |
| 2006/0235393 | A1 | * | 10/2006 | Bono et al. | 606/61 |
| 2006/0249520 | A1 | * | 11/2006 | DeMonte | 220/737 |
| 2007/0120362 | A1 | * | 5/2007 | Poder | 285/314 |
| 2007/0278211 | A1 | * | 12/2007 | Arens et al. | 219/536 |

* cited by examiner

HEATER ASSEMBLY FOR CLOTHES DRYER

FIELD OF THE INVENTION

The present invention relates to an electric heater assembly for supporting an electrical heating element and in particular it relates to a clothes dryer having such a heater assembly.

BACKGROUND OF THE INVENTION

Electric clothes dryers typically provide for warmed air flow through a rotating drum to remove moisture from clothing articles tumbling in the drum. The air is warmed by passing over energized electrical heating elements supported within a heater housing. In one construction of electrical clothes dryers, the rotating drum is closed at one end by a rear end head. This rear end head is provided with a pattern of apertures through which air passes into the rotating drum. In one embodiment, the rear end head rotates with the drum and in another embodiment the rear end head remains stationary while the cylindrical outer wall of the drum rotates.

A heater assembly is typically mounted within the dryer adjacent the rear end head of the drum. In the embodiment where the rear end head rotates with the drum, the heater assembly has been known to comprise a circular stationary rear support wall mounted to the rear wall of the dryer. This circular stationary wall typically has a peripheral flange that extends towards the rear end head of the drum and that is spaced from the rear end head to provide an air gap. A housing is formed between the rear end head, the rear support wall and the peripheral flange. In the past, an electrical heating element in the form of a helical coil has been mounted to the rear support wall of the clothes dryer assembly. This mounting has been accomplished by the use of metal brackets with insulators attached to the rear support wall, or more recently, by ceramic brackets attached to the rear wall of the housing. The brackets have typically been placed in two arcuate patterns whereby the coils are stretched from bracket to bracket forming a generally arcuate shape. While this heater arrangement has been quite effective, the assembly of the brackets onto the rear wall and then subsequent stretching of the heater coils onto the brackets about the heater rear wall is a relatively labour intensive operation. Further, in certain instances the number of coil rotations between brackets may not be consistent due to human operator error. This has been known to result in an uneven heat distribution.

In other heater assembly embodiments, it is known to mount coils to mica support insulating plates. Further, it is known to support a zigzag configured electrical heating element also known as meander-shaped windings. Such a heater configuration is disclosed in U.S. Pat. No. 4,845,345 issued Jul. 4, 1989. In this configuration, zigzag heating elements extend outwardly between apertures in a first mica plate. The first mica plate is secured to a second mica plate and portions of the heating element are held in place between the first and second mica plates. While this configuration results in a highly stable heating element which is simple to manufacture, this heating element configuration does not lend itself readily to use in electric clothes dryers.

BRIEF DESCRIPTION OF THE INVENTION

The present invention relates to an electric heater assembly for supporting an electrical heating element. Preferably, this heater assembly is adapted for use in a laundry clothes dryer. In a preferred clothes dryer embodiment, the heater assembly has at least one arcuate shaped support plate made of an insulation material that supports the electrical heating element. The support plate has a series of inner and outer notches cut into its inner and outer side edge portions. The support plate is adapted to be mounted to a housing support wall also forming a part of the electric heater assembly. The housing support wall has a first inner and second outer series of tab members that extend along respective arcs. Each of the tab members has a flap portion that is spaced from the housing support wall. The flap portions or members align with the inner and outer notches of the support plate allowing the support plate to be positioned against the housing support wall. The support plate may then be rotated relative to the housing support wall so that the flap members engage and hold the support plate relative to the housing support wall. The assembly of the heater element with respect to the support plate and the subsequent in shop assembly of the support plate relative to the housing support wall is relatively simple and efficient when compared to the use of prior art insulating brackets.

The insulation material for the arc-shaped support plate may comprise any suitable insulation material which can be formed into a plate. The preferred insulation material of the present invention is mica. It should be understood that other ceramic materials may be satisfactory.

The housing support wall in one embodiment may be mounted vertically in a clothes dryer such that the electrical heating assembly is mounted in the dryer adjacent a rear end head that closes off an end portion of the rotating drum in the dryer.

In accordance with an embodiment of the invention there is provided an electric heater assembly for supporting an electrical heating element in a clothes dryer having a rear panel. The electric heater assembly comprises at least one support plate and a housing support wall. The at least one support plate comprises an electrical insulation material for supporting the electrical heating element. The support plate comprises side edge portions respectively including notches spaced along the side edge portions. The housing support wall is mounted to the rear panel of the clothes dryer and comprises tab members extending therefrom. The tab members each comprise flap members spaced from the housing support wall. The flap members are positioned to respectively align with the notches of the support plate to permit the support plate to be positioned relative to the housing support wall and to slide relative to the housing support wall so that each of the flap members overlappingly engages in and holds the at least one support plate relative to the housing support wall.

In accordance one embodiment of the invention there is provided an electric heater assembly for supporting an electrical heating element. The heater assembly comprises at least one arcuate shaped support plate and a housing support wall. The support plate comprises an electrical insulation material for supporting the electrical heating element. The support plate comprises inner and outer concentrically curved side edge portions respectively including inner and outer notches spaced along the respective inner and outer concentric curved side edge portions. The housing support wall comprises a first series of spaced apart inner tab members extending therefrom and positioned along a first arc, and a second series of spaced apart outer tab members extending from the housing support wall and positioned along a second arc concentric with and radially outward of the first arc. Each of the first and second tab members has a flap member spaced from the housing support wall. The flap members of the inner and outer tab members are positioned to respectively align with the inner and outer notches of the support plate to permit the support plate to be positioned relative to the housing support wall and to be rotated relative to the housing support wall so that each of the flap members overlappingly engages at least one of the support plates so as to hold the support plate relative to the housing support wall.

BRIEF DESCRIPTION OF THE DRAWINGS

For a better understanding of the nature and objects of the present invention reference may be had by way of example to the accompanying diagrammatic drawings in which.

DETAILED DESCRIPTION OF THE INVENTION

Figure 1:
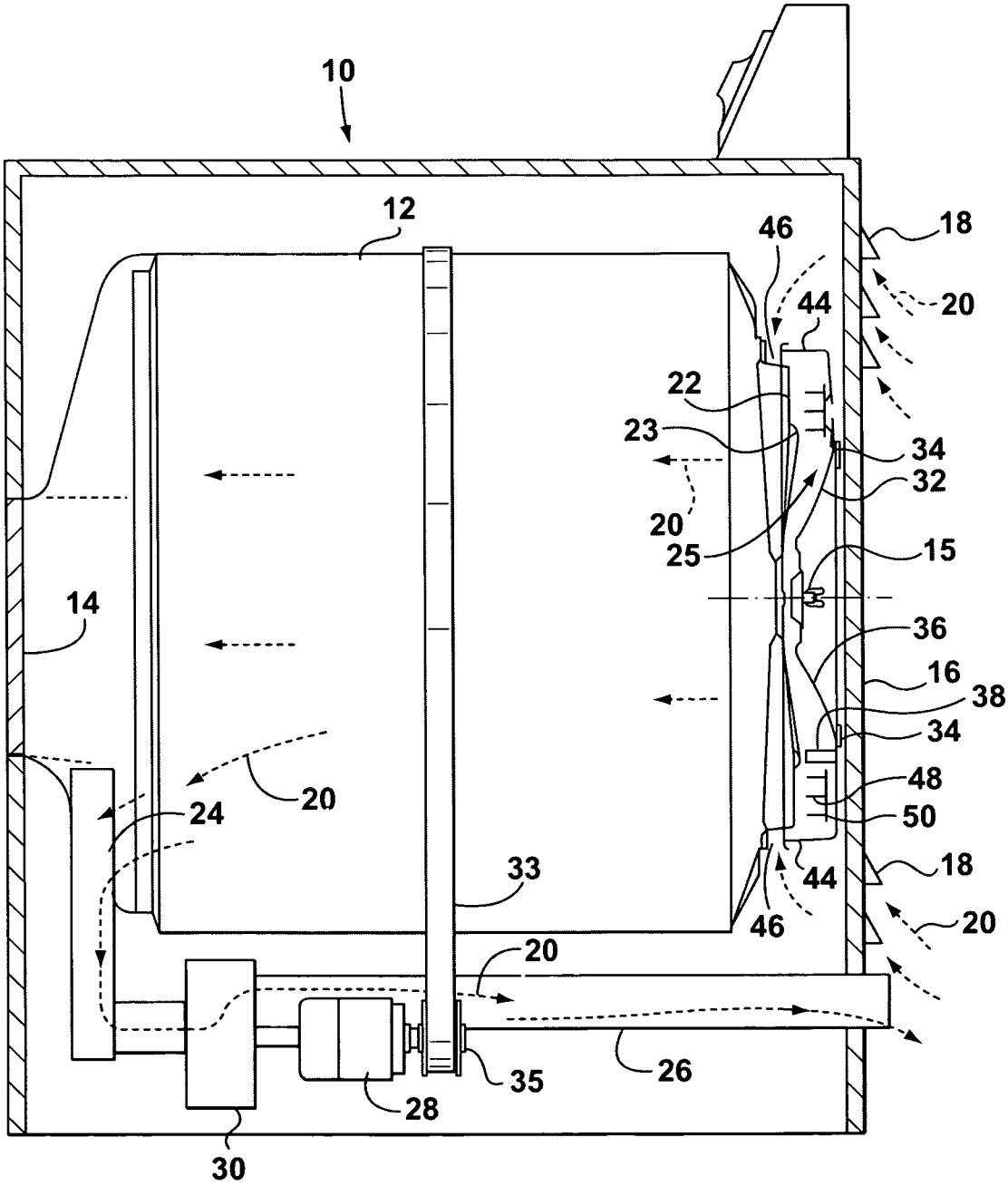
FIG. 1 is a side view of an exemplary electric clothes dryer that may benefit from the present invention comprising a rotating drum, rear end head and the heater assembly of the present invention.

The present invention relates to an electric heater assembly for supporting an electrical heating element and in particular it relates to a clothes dryer having such a heater assembly. Referring to FIG. 1 there is shown an exemplary embodiment of a clothes dryer 10 having a rotating drum 12 mounted therein. The rotating drum has an open front through which access can be gained through door 14 of the dryer 10 for the insertion and removal of clothing and other articles from the drum. The clothes dryer 10 has a rear panel 16 provided with a series or plurality of louvers 18 through which air may be drawn into the interior of the dryer 10. The airflow is shown by arrows 20 passing through the louvers, through openings or apertures 23 in the rear end head 22 of the dryer drum 12 through front ducting 24 and out through exhaust ducting 26. Rotating drum 12 is connected to the rear end head 22 so that drum 12 and the end head 22 rotate together within the dryer 12 about rear bearing 15 and front bearings (not shown). In an alternative embodiment, the rear end head 22 may be mounted to remain stationary in the dryer 10 and the drum 12 will rotate relative to the rear end head 22. This will employ a different type of rear bearing to that shown in FIG. 1.

Motor 28 draws or rotates fan 30 to draw the air 20 through the drum 12. The motor 28 through pulley 35 and belt 33 also causes the rotation of the dryer drum 12. In an alternative embodiment, separate motors may be used to rotate the fan 30 and the drum 12.

A heater assembly 32 is mounted by suitable bolts 34 to the rear panel 16 of the dryer 10. The heater assembly 32 is positioned adjacent the end head 22 to define a heater housing 25. The heater assembly 32 has a housing supporting wall 36 that is spaced from the rear end head 22.

The heater assembly 32 has an upstanding outer peripheral wall or flange portion 44 that extends around the periphery of the housing support wall 36. The flange portion 44 is angled approximately at 90° to the housing support wall 36. The flange portion 44 further extend towards the rear end head 22. An air gap 46 extends between the flange portion 44 and the rear end head 22 of the dryer drum.

Zig-zag configured heating elements 48 are mounted via support plate assembly 50 to the housing support wall 36 of the heater assembly 32 in a manner described in more detail hereinafter. The heating elements 48 are connected to a source of electrical supply through terminals. When electrical energy is fed via the terminals to the heating elements 48, the elements dissipate heat and warm air passing over and around the elements 48. The warmed air subsequently enters the drum 12 through openings 23 in the rear end head 22 to dry articles and clothing contained in the drum 12.

A spacer 38 is mounted to heater housing 34 inwardly adjacent the support plate assembly 50. The spacer 38 keeps rear end head 22 from contacting heating elements 48 in the event the drum 12 shifts within the cabinet of the clothes dryer 10 due to mishandling during shipment.

Figure 2:
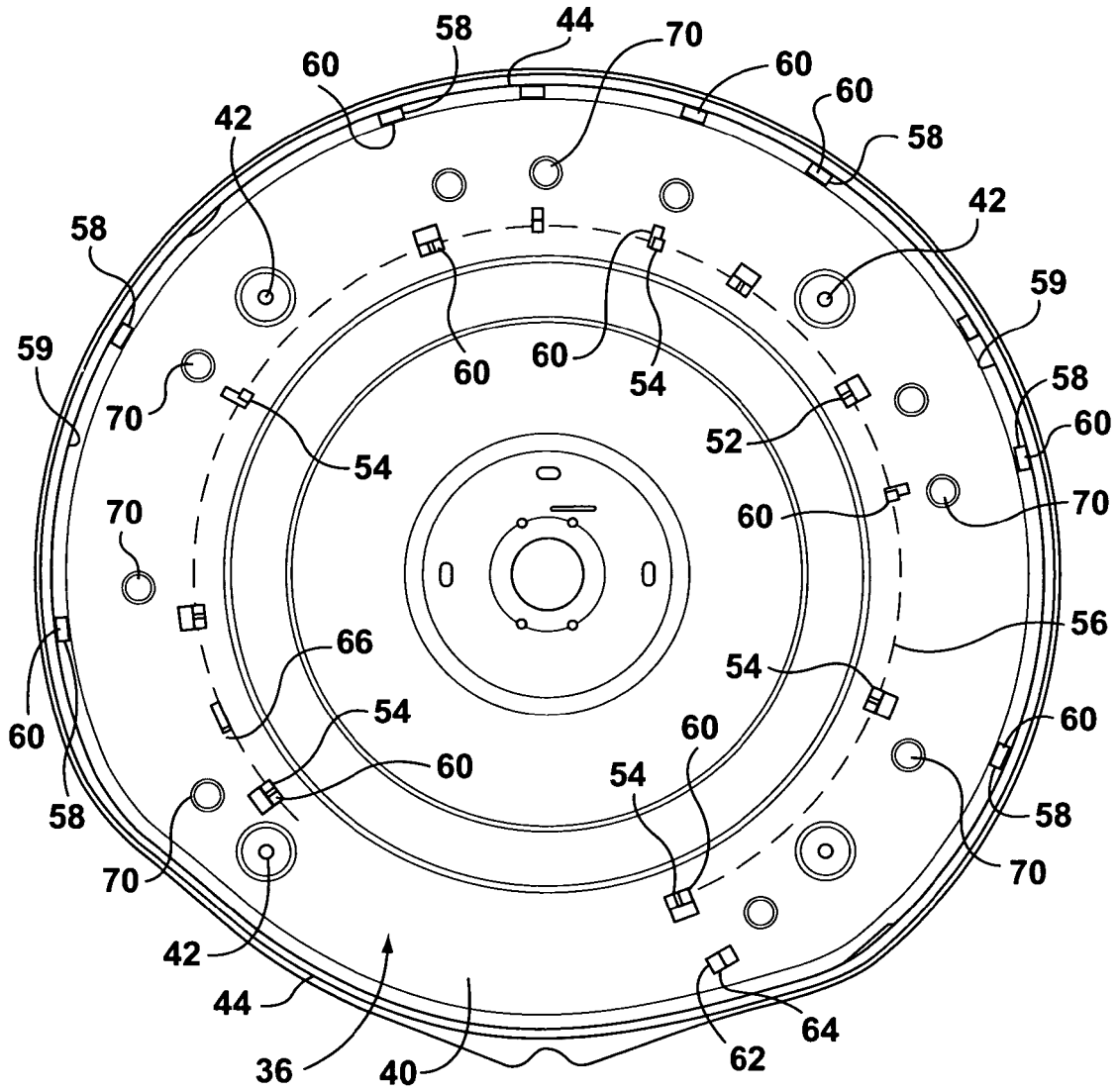
FIG. 2 is a front view of the heater support wall.
Figure 6:
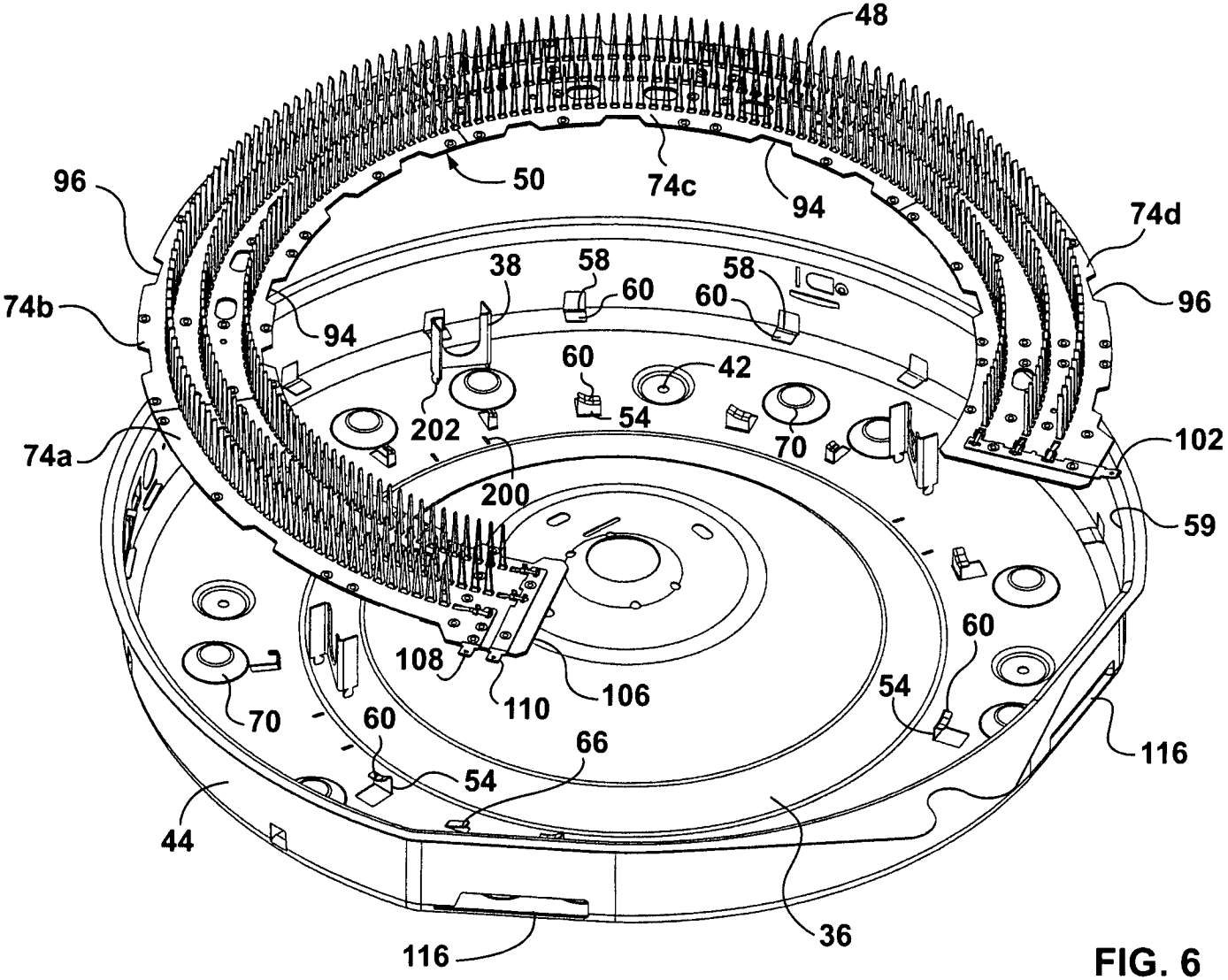
FIG. 6 is an exploded view of the heater assembly.

Referring to FIGS. 2 and 6, the housing support wall 36 is shown to comprise a main wall portion 40 surrounded by the outer peripheral wall or flange portion 44. The outer peripheral wall or flange portion 44 is generally circular in shape when shown from this front view. In this view the flange portion 44 is shown to comprise a plurality of arcs forming the generally circular configuration which is not a true circle. The main wall portion 40 has four apertures 42 through which locating bolts 34 (FIG. 1) pass to mount the housing support wall 36 to the rear panel 16 (FIG. 1) of the clothes dryer 10. The housing support wall 36 shown in FIGS. 2 and 6 is adapted to be mounted vertically within the clothes dryer 10 as shown in FIG. 1.

The housing support wall 36 has a first series of spaced apart inner tab members 54. The inner tab members 54 are cut and pushed out from the main wall portion 40. It should be understood that in an alternative embodiment, the tab members 54 may be separate parts secured by suitable means such as, for example, bolts or screws to the main wall portion. The inner tab members 54 are positioned along a first arc represented by dashed line 56. The housing support wall 36 has a second series of spaced apart outer tab members 58. The outer tab members 58 extend inwardly from the outer peripheral flange portion 44. The outer tab members are cut and pushed in from the peripheral flange portion 44. In an alternative embodiment the outer tab members 58 may comprise separate pieces that are fixed to the outer peripheral portion 44 by suitable means such as, for example, screws. In still yet another alternative embodiment the outer tab members 58 may extend from the main wall portion 40 of the housing support wall 36 in a manner similar to that shown for the inner tab members 54. The outer tab members 58 are positioned along a second arc 59 following the circumference of the flange portion 44. This second arc is not a true arc in view of the fact that the outer peripheral flange portion 44 is not in a true circle shown in FIG. 2. In an alternative embodiment, the second arc could be a continuous arc. Each of the inner and outer tab members 54, 58 have a flange member 55 extending from the housing support wall terminating at a flap member 60 that is spaced from the main wall portion 40 of the housing support wall 36. The flap members 60 extend either parallel or substantially parallel to the main wall portion 40. The positioning of the inner and outer tab members 54, 58 along their respective radially displaced arcs 56, 59 is chosen to facilitate supporting the insulating support plate assembly 50. The manner in which the inner and outer tab members 54, 58 support the support plate assembly 50 is described in more detail hereinafter.

The housing support wall 36 further includes at least one first limiting tab member 62 having a corresponding flap member 64 that is spaced from the housing support wall 36 and, as shown, form the main wall portion 40. The housing support wall 36 further comprises a second limiting tab member 66. The purpose of the limiting tab members 62 and 66 will be described in more detail hereinafter.

The housing support wall 36 further includes raised bosses 70 shown spaced about the main wall portion 40 between the first and second arcs 56, 59. Alternatively, the raised bosses 70 may only have upper surface portions that are positioned between the first and second arcs 56, 59.

Figure 7:
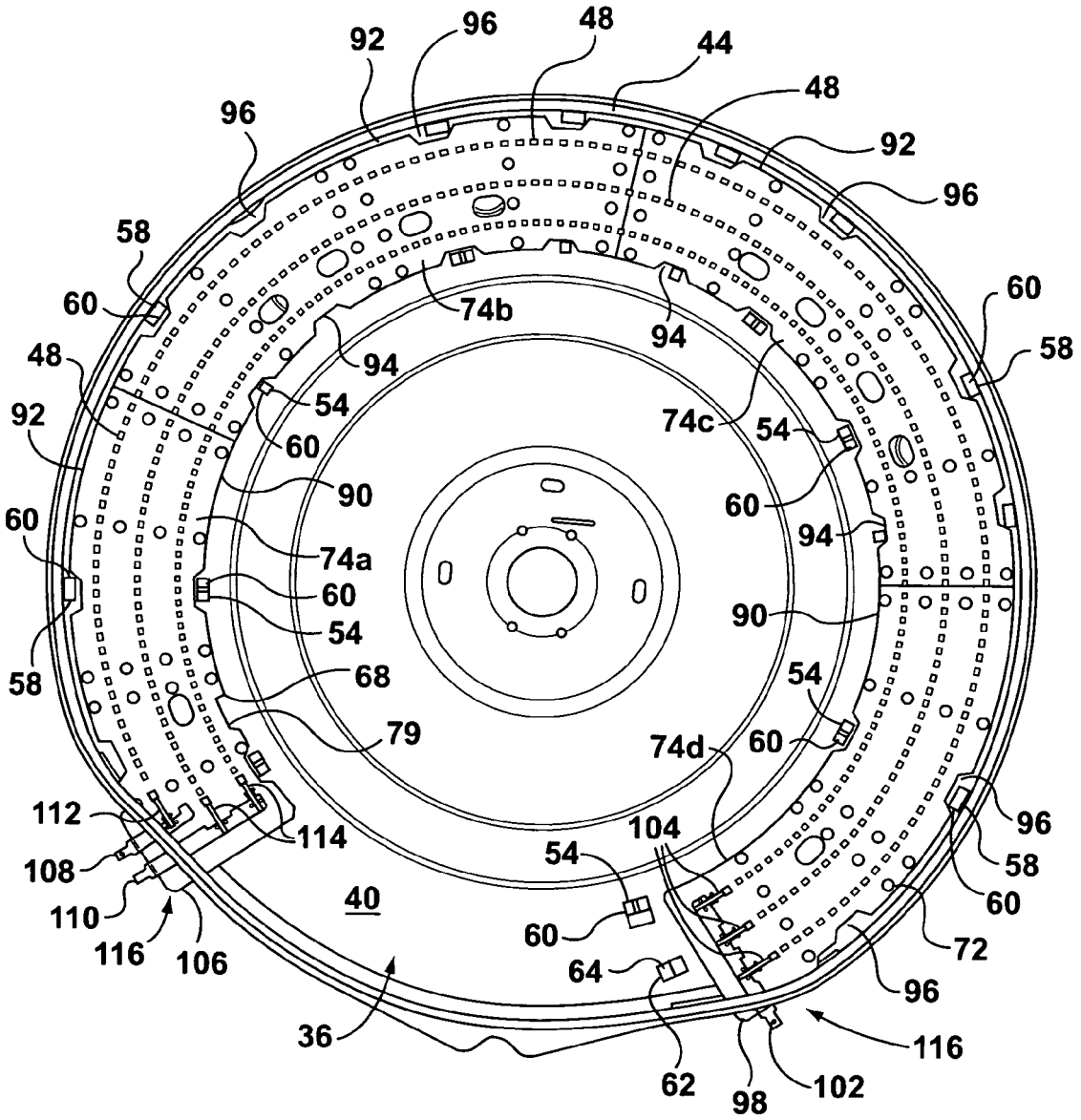
FIG. 7 is a front view of the heater assembly of the present invention showing heater support plates positioned relative to the heater support wall.
Figure 8:
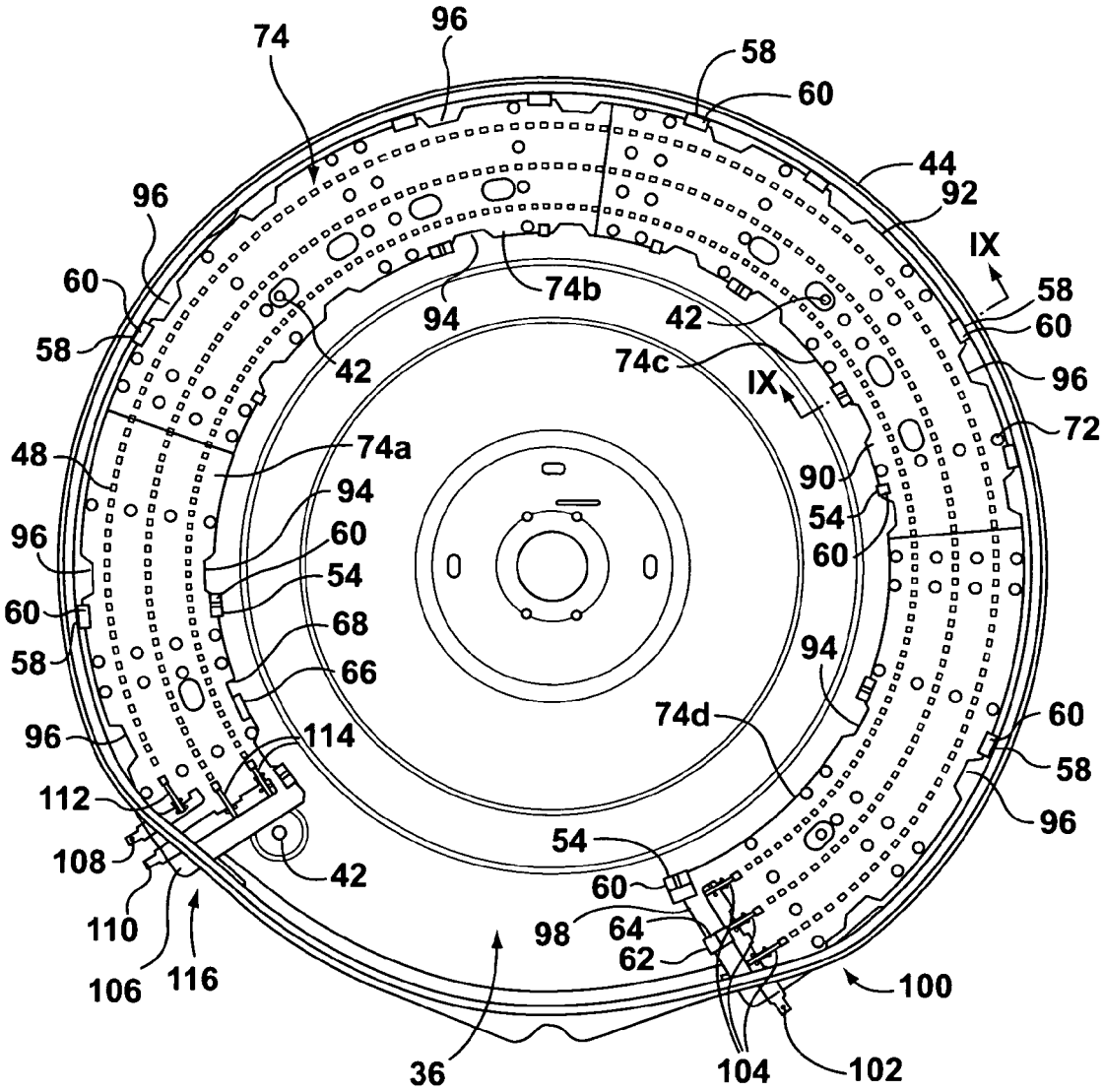
FIG. 8 is a front view of the heater assembly of the present invention showing heater support plates fixedly positioned relative to the heater support wall.

Referring now to FIGS. 3 through 12, the electric heater assembly 32 further comprises the arcuately shaped support plate assembly 50. The support plate assembly 50 supports zigzag shaped heating elements 48. The support plate assembly 50 comprise upper and lower, or first and second, overlapping arcuate shaped supporting plates 74, 76. The supporting plates 74, 76 are each formed from multiple segments of insulating plates which are secured together by rivets 72. In FIGS. 7 and 8 the upper plate 74 comprises segments 74*a*, 74*b*, 74*c* and 74*d*. Similar segments exist for the lower plate 76 which are offset from the upper plate segments so that no continuous crack or joint extends through the upper and lower plates 74, 76. It should be understood that, alternatively, one continuous arcuate shaped supporting plate for each of the two supporting plates may be used, however by using multiple sections of symmetrical configuration for each of upper and lower plates 74, 76 as shown, the multiple segments produces less scrap material from the blank of mica from which the plate segments are cut. Rivets 72 pass through the various sections so as to result in the formation of a pair of composite support plates 74, 76 fastened together to support the heating element 48. The upper mica plate 74 has at least one, but preferably three series of apertures 82 each extending in an arc about the mica plate. Along each of these arcs the heating element 48 extends. The heating element has a flat portion 84 (FIG. 5) that is sandwiched between the plates 74, 76 as well as a zigzag portion 86 that extends away from the supporting plates 74, 76.

The construction of the supporting plates may comprise any suitable insulating ceramic material and preferably, is a mica material. The mica material provides for good electrical insulating properties however, the mica is subject to expansion and contraction as it is heated and cooled with the energization and deenergization of the heating elements 48.

As shown in the drawings the first and second, or upper and lower, support plates 74, 76 each comprise inner and outer concentrically curved side edge portions 90 and 92 respectively. These side edge portions 90, 92 each include a plurality of inner and outer notches 94, 96 spaced along respective inner and outer concentric curved side edge portions 90, 92. The notches are shown to have angled edges.

Figure 3:
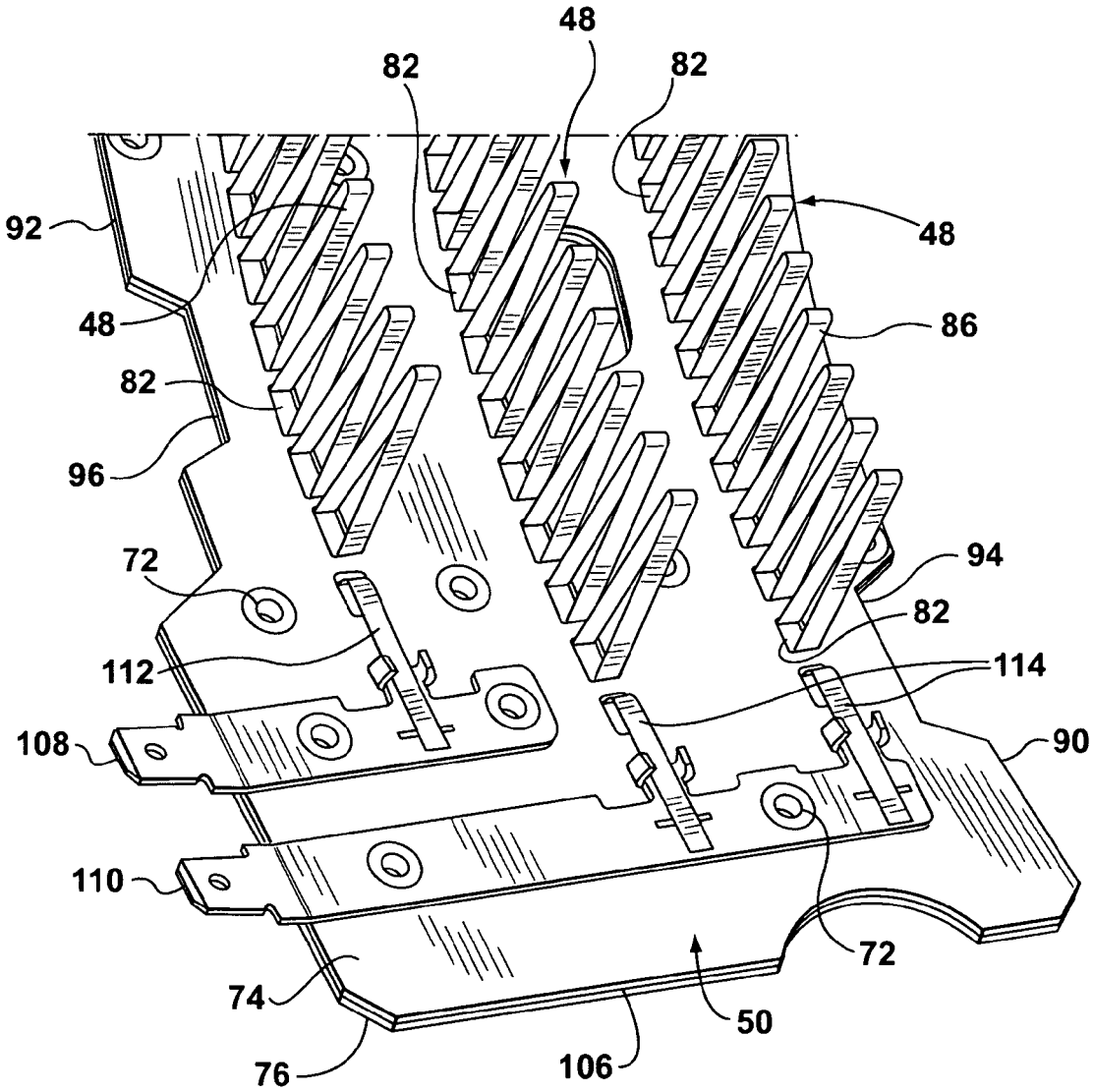
FIG. 3 is perspective view of the support plates adjacent an end thereof showing terminal connections with the heating elements in more detail.
Figure 4:
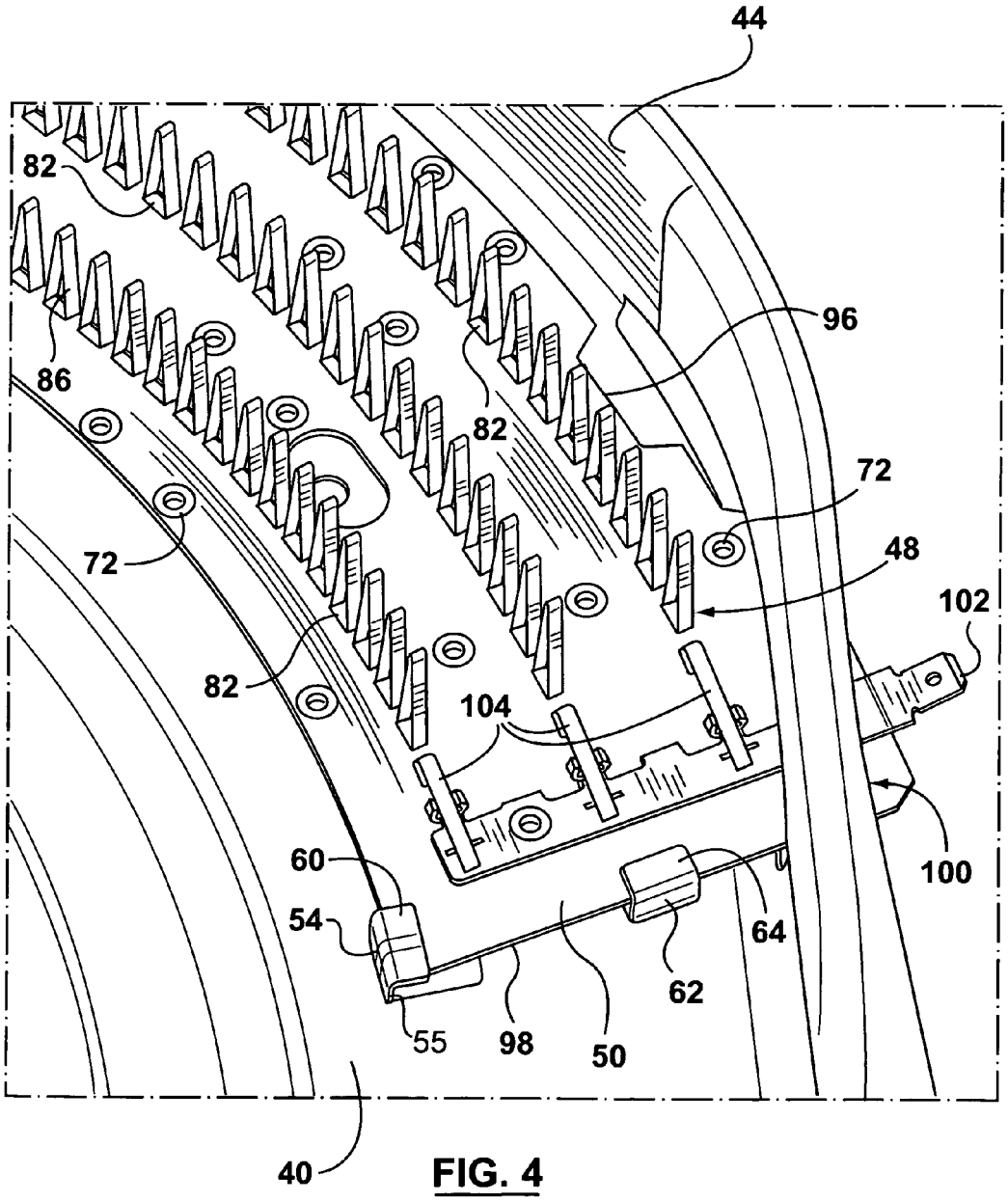
FIG. 4 is a perspective view of the support plates adjacent another end thereof showing other terminal connections with the heating element in more detail relative to the housing support wall and in-turned peripheral flange portion.
Figure 5:
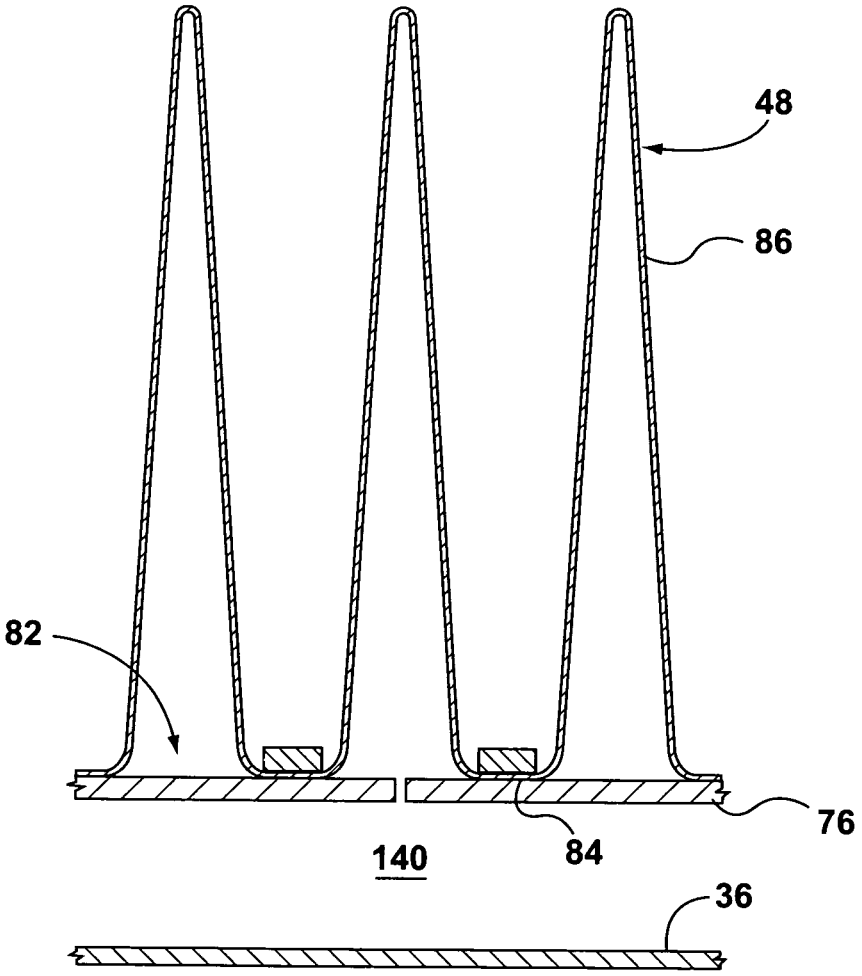
FIG. 5 is a sectional view showing the mounting of the heating element between two support plates.

In FIGS. 4, 7 and 8 the support plates 74, 76 are shown to have a first end portion 98 that extends through an opening 100 in the peripheral wall or flange portion 44 of the housing support wall 36. This first end portion supports a terminal 102 that is connected through links 104 to each of the three heating elements 48. This terminal 102 is connected to ground. Referring to FIGS. 3, 7 and 8 the other or second end portion 106 of the mica support plates 74, 76 are shown to include terminals 108 and 110 respectively connected by links 112 and 114 respectively to a first one of heating elements 48 and to a parallel connection the second and third heating elements 48. Each of terminals 108 and 110 is connected to an electrical circuit and is selectively and independently energizable so that various levels of heating or energization of the heating elements may be utilized. The terminals 108, 110 will also extend through an opening or aperture 116 in the flange portion 44 of the housing support wall 36. The flange portion 44 may also be provided at the openings 100, 116 with a corresponding tab member (not shown) that can be bent over respective end portions 98, 106 of the support plates 74, 76 so as to provide mechanical reinforcement to the end portions 98, 106 of the support plates 74, 76 during assembly and electrical connection of the terminals.

Figure 11:
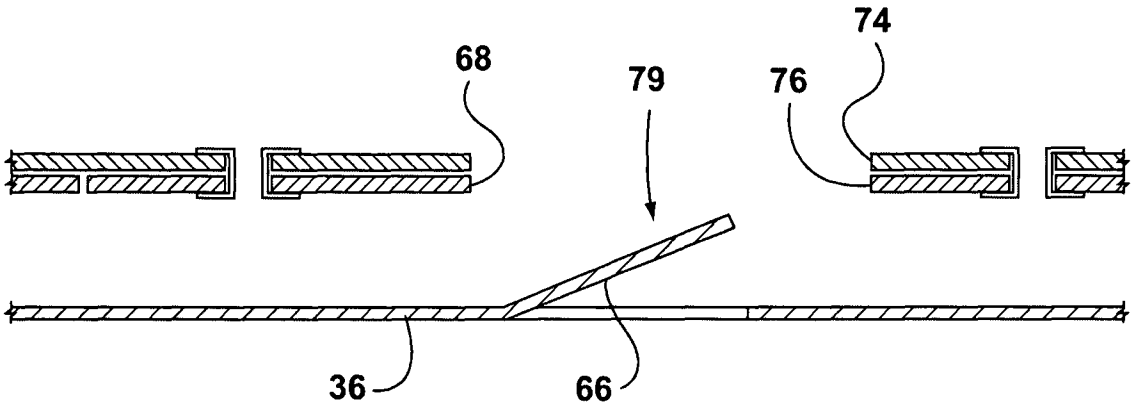
FIG. 11 is a side sectional view of FIG. 10.
Figure 12:
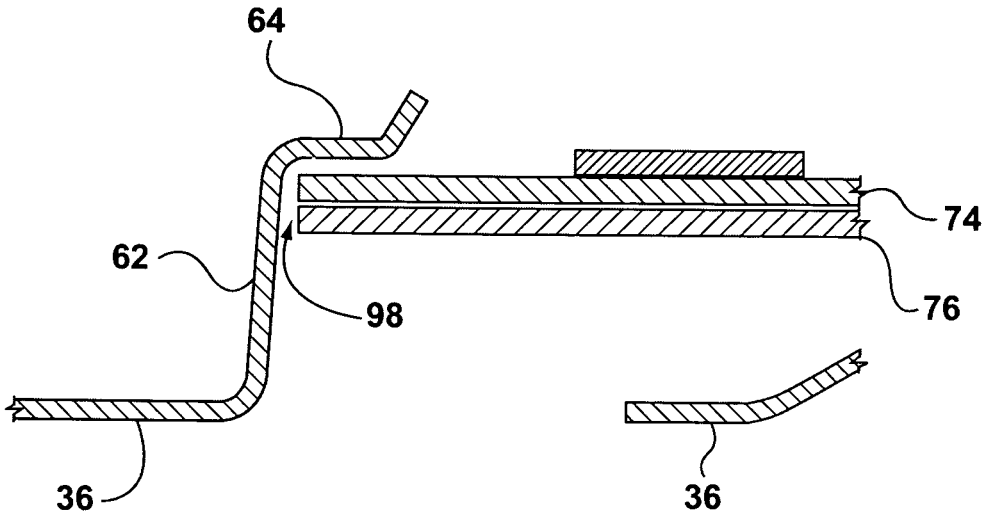
FIG. 12 is a detailed sectional view of the stationary limiting tab member.

Referring to FIGS. 7 and 8, the assembly of the support plates 74, 76 holding the heating elements 48 to the housing support wall 36 is best shown. In FIG. 7, the end portions 98, 106 of the plates 74, 76 are passed through the openings 100, 116 in the flange portion 44. Next, the plates 74, 76 are moved into position against the main wall portion 40 of the outer wall portion. To accomplish this, the inner and outer tab members 54 and 58 align with the inner and outer notches 94, 96 on the plates 74, 76. This allows the plates 74, 76 to pass over and between the inner and outer tabs 54, 58. It should be understood that when the heater assembly 32 is supported vertically within the clothes dryer 10, the support plates 74, 76 will be supported by the inner support tab members 54 due to gravity. The flange member 55 engages and radially supports the inner curved side edge portion 90 of the plates 74, 76. Once in this position, the plates 74, 76 are slid or rotated clockwise relative to the housing support wall 36 bringing the flaps members 60 of each of the tabs 54 and 58 into overlapping engagement with an upper surface portion of the upper plate 74 (see FIG. 9). The rotation of the plates 74, 76 is shown to be limited in FIGS. 8 and 12 by the limiting tab 62 and its flap 64 overlappingly engaging the first end portion 98 (FIG. 12). Once in the position of FIG. 8, the flap or limiting tab member 66 adjacent the second end portion 106 of the plates 74, 76 is normally in a lowered position (FIGS. 10 and 11) and is bent upright by suitable means to engage the edge 68 of plates 74, 76 (FIG. 8). In FIG. 11, limiting tab member 66 is angled upwardly at about 20° in its lowered position. The tab 66 can comprise a tab or flange member that is moved into position to engage a the edge 68 of the rectangular notch 79 in the inner curved wall or inside edge portion 90 of the support plates 74, 76. The location of the rectangular notch 79 provides a surface or edge 68 against which the moveable flap or tab 66 abuts to prevent the support plate assembly 50 from shifting out of its fixed position as shown in FIG. 8 relative to the support wall 36.

It should be understood that some radial play exists, as well as axial play, between the support plates 74, 76 and all the tab members 54, 56, 62 and 66. This limited play permits the expansion and contraction of the support plates 74, 76 as they are heated and cooled with the energization and deenergization of the heating element 48. Hence the overlapping engagement referred to herein is a loose engagement.

Figure 9:
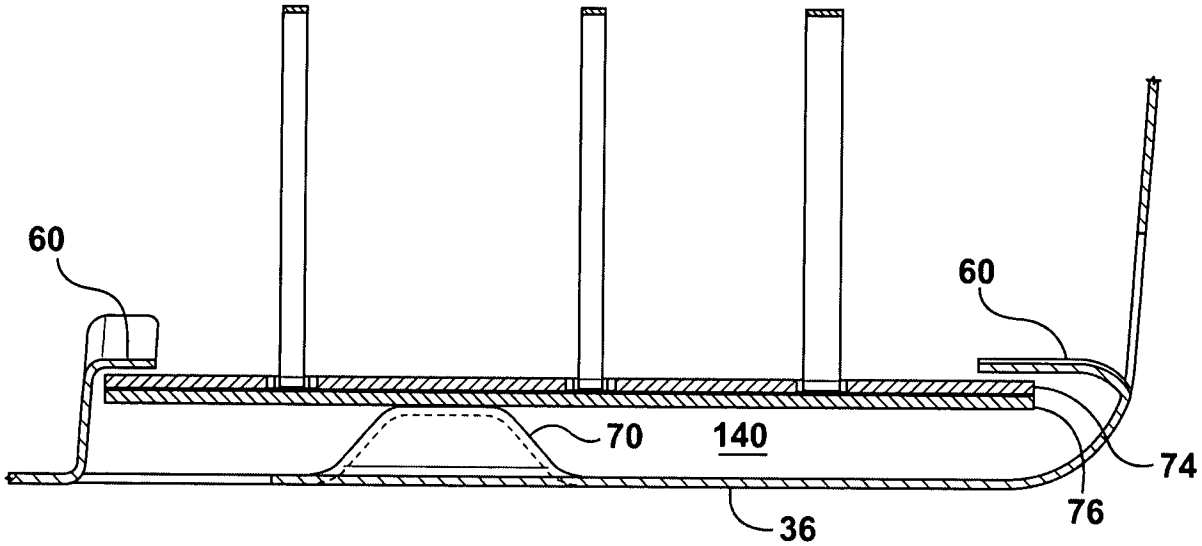
FIG. 9 is a sectional view taken along lines IX-IX of FIG. 8.
Figure 10:
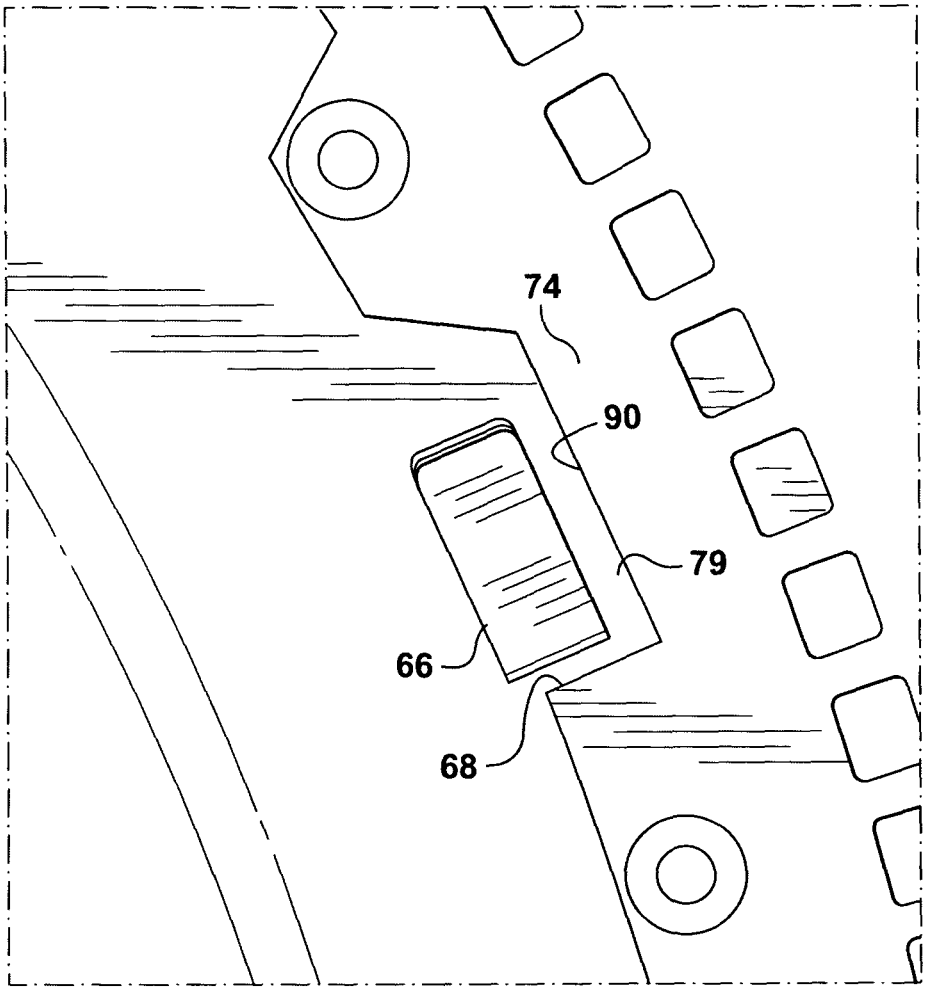
FIG. 10 is a detailed plan view of the foldable limiting tab member shown in FIG. 8.

Further, the flaps 60 hold the support plates 74, 76 against the raised boss portions 70 (see FIG. 9). The purpose of this raised boss portion 70 is to space the supporting plates 74, 76 a predetermined distance and, in this embodiment approximately 6.3 mm, away from the main wall portion 40. This spacing has two purposes. One purpose is to provide an air space or gap 140 through which air may circulate behind the support plates 74, 46 to provide an air flow cooling path behind portions of the plates 74, 76. Secondly, the spacing provides sufficient clearance to reduce arcing from the heating element to the housing support wall 36 through any joint between adjacent segments of the lower support plate 76. With respect to FIG. 9, the raised boss portion 70 is shown to the left of center of the support plates 74, 76 because the raised boss 70 is located upstream of the drawing section taken through the inner and outer tab members 56, 58. If the section had been taken through the raised boss portion 70, it would have illustrated the raised boss portion being located more centrally of the support plates 74, 76.

As shown in FIG. 6, the spacer 38 of FIG. 1 is mounted in slots 200 by locating feet 202. The locating feet 202 are shaped to permit the feet 202 to enter slots 200 and be twisted to lock in place.

While the invention has been described in terms of various specific embodiments, those skilled in the art will recognize that the invention can be practiced with modifications within the spirit and scope of the present invention as disclosed herein.

What is claimed is:

1. An electric heater assembly for supporting an electrical heating element in a clothes dryer having a rear panel comprising:

a first support plate and a second support plate comprising an electrical insulation material for supporting the electrical heating element, the first support plate overlapping the second support plate, the first support plate and the second support plate each comprising side edge portions respectively including notches spaced along the side edge portions; and, a housing support wall vertically mounted to the rear panel of the clothes dryer and comprising tab members extending from the housing support wall, the tab members comprising flap members spaced from the housing support wall and parallel to the housing support wall, the flap members being positioned to respectively align with the notches of the first support plate and the second support plate to permit the first support plate and the second support plate to be positioned adjacent the housing support wall and to rotate and slide relative to the housing support wall so that each of the flap members overlappingly engages and holds the first support plate and the second support plate adjacent the housing support wall in loose engagement with radial and axial play between the tab members and the first and second support plates to permit expansion and contraction of the first and second support plates during heater assembly operation.

2. The heater assembly of claim 1 wherein the housing support wall comprises a main wall portion and a series of raised bosses extending from the main wall portion and the support plate being held against the raised bosses by the flap members whereby an air gap is defined between the first support plate and the second support plate and the main wall portion of the housing support wall.

3. The heater assembly of claim 1 wherein:

each of the first and the second support plate comprises a mica material, and the first support plate has at least one series of spaced apart apertures; and, first portions of the electrical heating element are held between the first and the second support plate and zig zag portions of the electrical heating element extending from the apertures.

4. An electric heater assembly for supporting an electrical heating element comprising:

at least one arcuate shaped support plate comprising an electrical insulation material for supporting the electrical heating element, the at least one arcuate shaped support plate comprising inner and outer concentrically curved side edge portions respectively including inner and outer notches spaced along the respective inner and outer concentric curved side edge portions; and a housing support wall comprising a first series of spaced apart inner tab members extending from the housing support wall and positioned along a first arc, and a second series of spaced apart outer tab members extending from the housing support wall and positioned along a second arc concentric with and radially outward of the first arc, each inner and outer tab member having a flap member spaced from the housing support wall and parallel to the housing support wall, the flap members of each inner and outer tab member being positioned to respectively align with inner and outer notches of the at least one arcuate shaped support plate to permit the at least one arcuate shaped support plate to be positioned adjacent the housing support wall and rotated relative to the housing support wall so that each of the flap members overlappingly engages and holds the at least one arcuate shaped support plate adjacent the housing support wall in loose engagement with radial and axial play between the inner and outer tab members and the at least one arcuate shaped support plate to permit expansion and contraction of the at least one arcuate shaped support plate during heater assembly operation.

5. The heater assembly of claim 4 wherein the insulation material comprises mica.

6. The heater assembly of claim 5 wherein the housing support wall comprises a main wall portion and a series of raised bosses extending from the main wall portion and the at least one arcuate shaped support plate being held against the raised bosses by the flap members whereby an air gap is defined between the at least one arcuate shaped support plate and the main wall portion of the housing support wall.

7. The heater assembly of claim 4 wherein the housing support wall comprises a main wall portion from which the first series of tab members extend and an in-turned peripheral flange portion surrounding the main wall portion, and the second series of tab members extend from the in-turned peripheral flange portion.

8. The heater assembly of claim 7 wherein the housing support wall comprises a series of raised bosses extending from the main wall portion and the at least one arcuate shaped support plate is held against the raised bosses by the flap members whereby an air gap is defined between the at least one arcuate shaped support plate and the main wall portion of the housing support wall.

9. The heater assembly of claim 8 wherein:

the at least one arcuate shaped support plate comprises first and second end edge portions, and the housing support wall further comprises at least one first limiting tab member having a corresponding flap member spaced from the housing support wall for engaging the at least one arcuate shaped support plate and the first limiting tab member engaging the first end edge portion when the at least one arcuate shaped support plate is rotated relative to the housing support wall, and the housing support wall further including at least one second limiting tab member over which the at least one arcuate shaped support plate is initially positioned, and the second limiting tab member being bent into engagement with a rectangular notch in the outer concentrically curved side edge portion of the at least one arcuate shaped support plate after the at least one arcuate shaped support plate is rotated relative to the housing support wall to lock the at least one arcuate shaped support plate in fixed position adjacent the housing support wall.

10. The heater assembly of claim 6 wherein:

the at least one arcuate shaped support plate comprises first and second end edge portions, and the housing support wall further comprises at least one first limiting tab member having a corresponding flap member spaced from the housing support wall for engaging the at least one arcuate shaped support plate and the first limiting tab member engaging the first end edge portion when the at least one arcuate shaped support plate is rotated relative to the housing support wall, and the housing support wall further including at least one second limiting tab member over which the at least one arcuate shaped support plate is initially positioned, and the second limiting tab member being bent into engagement with the at least one arcuate shaped support plate after the at least one arcuate shaped support plate is rotated relative to the housing support wall to lock the at least one arcuate shaped support plate in fixed position adjacent the housing support wall.

11. The heater assembly of claim 4 wherein:

the at least one arcuate shaped support plate comprises first and second end edge portions, and the housing support wall further comprises at least one first limiting tab spaced from the housing support wall for engaging the at least one arcuate shaped support plate to engage and to limit movement of the at least one arcuate shaped support plate when the at least one arcuate shaped support plate is rotated relative to the housing support wall, and the housing support wall further including at least one second limiting tab member over which the at least one arcuate shaped support plate is initially positioned, and the second limiting tab member being bent into engagement with the at least one arcuate shaped support plate after the at least one arcuate shaped support plate is rotated relative to the housing support wall to lock the at least one arcuate shaped support plate in fixed position adjacent the housing support wall.

12. The heater assembly of claim 5 wherein the housing support wall comprises a main wall portion from which the first series of tab members extend and an in-turned peripheral flange portion surrounding the main wall portion, and the second series of tab members extend from the in-turned flange portion.

13. The heater assembly of claim 4 wherein the housing support wall comprises a series of raised bosses extending from the main wall portion and the at least one arcuate shaped support plate is held against the raised bosses by the flap members whereby an air gap is defined between the at least one arcuate shaped support plate and the main wall portion of the housing support wall.

14. The heater assembly of claim 4 wherein each of the first series of spaced apart inner tab members comprises a flange member extending from the housing support wall and terminating at the flap member, and the flange member engaging and radially supporting the inner concentrically curved side edge portion of the at least one arcuate shaped support plate.

15. The heater assembly of claim 14 wherein the electrical heating element has terminals extending from a first end portion of the at least one arcuate shaped support plate, and the first end portion extending through an opening in the housing support wall.

16. An electric clothes dryer comprising:

a rotating drum;

a rear end head closing of an end of the drum and having a plurality of apertures through which air flows into the drum; and an electric heater assembly mounted in the dryer adjacent the rear end head, the heater assembly supporting at least one electrical heating element which is energized to warm air flow passing across the electrical heating element, through the apertures and into the drum, the heater assembly comprising:

first and second arcuate shaped support plates, the first arcuate shaped support plate overlapping the second arcuate shaped support plate, the first and the second arcuate shaped support plates supporting the electrical heating element, the first and second arcuate shaped support plates each comprising a mica material, and the first arcuate shaped support plate has at least one series of spaced apart apertures extending in an arc about the first support plate, and first portions of the electrical heating element are held between the first and second arcuate shaped support plates and zig zag portions of the electrical heating element extend from the apertures, the first and second arcuate shaped support plates comprising inner and outer concentrically curved side edge portions respectively including inner and outer notches spaced along the respective inner and outer concentric curved side edge portions; and a housing support wall for mounting vertically in the clothes dryer, the housing support wall comprising a first series of spaced apart inner tab members extending from the housing support wall and positioned along a first arc, and a second series of spaced apart outer tab members extending from the housing support wall and positioned along a second arc concentric with and radially outward of the first arc, each of the first and second tab members comprising a flap member spaced from the housing support wall and parallel to the housing support wall, the flap members of the inner and outer tab members being positioned to respectively align with the inner and outer notches of the first and second arcuate shaped support plates to permit the first and second arcuate shaped support plates to be positioned adjacent the housing support wall and rotated relative to the housing support wall so that each of the flap members overlappingly engages at least one of the first and second arcuate shaped support plates so as to hold the first and second arcuate shaped support plates adjacent the housing support wall in loose engagement with radial and axial play between the spaced apart inner and outer tab members and the first and second arcuate shaped support plates during heater assembly operation.

17. The electric clothes dryer of claim 16 wherein the first and second arcuate shaped support plates are secured to each other by rivets.

18. The electric clothes dryer of claim 16 wherein the first and second arcuate shaped support plates comprises a plurality of first and second arcuate shaped support plate segments joined together.

19. The electric clothes dryer of claim 18 wherein adjacent ones of the first and second arcuate shaped support plate segments are joined together by lapping joints.

20. The electric clothes dryer of claim 16 wherein the housing support wall comprises a main wall portion and a series of raised bosses extending from the main wall portion and the first and the second arcuate shaped support plates being held against the raised bosses by the flap members whereby an air gap is defined between the first and the second arcuate shaped support plates and the main wall portion of the housing support wall.

21. The electric clothes dryer of claim 20 wherein:

the first and the second arcuate shaped support plates each comprise first and second end edge portions, and the housing support wall further comprises at least one first limiting tab member having a corresponding flap member spaced from the housing support wall for engaging the first and the second arcuate shaped support plates and the first limiting tab member engaging the first edge portion when the first and the second arcuate shaped support plates are rotated relative to the housing support wall, and the housing support wall further including, at least one second limiting tab member over which the first and the second arcuate shaped support plates are initially positioned, and the second limiting tab member being bent into engagement with the first and the second arcuate shaped support plates after the first and the second arcuate shaped support plates are rotated relative to the housing support wall.

22. The electric clothes dryer of claim 16 wherein:

the first and the second arcuate shaped support plates each comprise first and second end edge portions, and the housing support wall further comprises at least one first limiting tab member having a corresponding flap member spaced from the housing support wall for engaging the first and the second arcuate shaped support plates and the first limiting tab member engaging the first edge portion when the first and the second arcuate shaped support plates are rotated relative to the housing support wall, and the housing support wall further including at least one second limiting tab member over which the first and the second arcuate shaped support plates are initially positioned, and the second limiting tab member being bent into engagement with the first and the second arcuate shaped support plates after the first and the second arcuate shaped support plates are rotated relative to the housing support wall.

23. The electric clothes dryer of claim 22 wherein the housing support wall comprises a main wall portion from which the first series of tab members extend and an in-turned peripheral flange portion surrounding the main wall portion, and the second series of tab members extend from the in-turned flange portion.

24. The electric clothes dryer of claim 23 wherein each of the first series of spaced apart inner tab members comprises a flange member extending from the housing support wall and terminating at the flap member, and the flange member engaging and radially supporting the inner curved side edge portion of the first and the second arcuate shaped support plates.

25. The electric clothes dryer of claim 16 wherein the electrical heating element has terminals extending from a first end portion of the first and the second arcuate shaped support plates, and the first end portion extending through an opening in the housing support wall.

* * * * *